United States Patent [19]

Ignatko et al.

[11] 4,324,509

[45] Apr. 13, 1982

[54] MECHANIZED LONGWALL SYSTEM FOR MINING

[75] Inventors: György Ignátkó; Zoltán Ilyés, both of Budapest; Ferenc Németh, Mór; Mátyás Rácz, Környe; Albert Varga; Jenö Varró, both of Oroszlány, all of, Hungary

[73] Assignees: Kozponti Banyaszati Fejlesztesi Intezet, Budapest; Oroszlányi Szenbanyak, Oroszlány, both of Hungary

[21] Appl. No.: 151,774

[22] Filed: May 21, 1980

[30] Foreign Application Priority Data

May 23, 1979 [HU] Hungary ..... KO 2993

[51] Int. Cl.[3] ..... E21D 23/00

[52] U.S. Cl. ..... 405/299; 405/291

[58] Field of Search ..... 405/291, 296, 299, 300, 405/301; 299/31, 33; 198/316, 599

[56] References Cited

U.S. PATENT DOCUMENTS 3,855,805 12/1974 Nakajima ..... 405/299

FOREIGN PATENT DOCUMENTS 839498 4/1970 Canada ..... 405/300

*Primary Examiner*—David H. Corbin

[57] ABSTRACT

A mechanized longwall system for mines is provided which includes face roof supporting units disposed along the longwall and connected to a face support track by hydraulic advancing cylinders, each unit including a floor and roof element, a drift transport track mounted perpendicularly to one end of the face transport track, including two drift supporting units coupled with hydraulic linkages to the face supporting units, a guide system arranged on one of the floor elements of the drift supporting units and guiding a transfer unit in the longitudinal direction of the drift transport track, the arrangement being such that shifting of a drift supporting unit is accompanied by a simultaneous shifting of the face conveyor apparatus.

6 Claims, 9 Drawing Figures

MECHANIZED LONGWALL SYSTEM FOR MINING

FIELD AND BACKGROUND OF THE INVENTION

The invention relates to a mechanised longwall system for mining.

Mechanised longwall systems for mining are known of the kind including face roof support units disposed adjacent to each other along the longwall and connected via hydraulic advancing cyclinders to a face transport track laid along the length of the longwall, each unit comprising a floor element and a roof element supported on hydraulic props, the system further including a drift transport track arranged at and perpendicular to that end of the face transport track so as to extend into the drift in the conveying direction.

In these known mechanical longwall systems all the roof support units over the entire length of the longwall are of the same construction, and the working area formed at the junction between the face and the drift is timbered out with a large number of individual props made of wood or steel or with individual hydraulic props. This solution is not only very cumbersome and laborious, but it is also unfavourable from the safety point of view.

The mechanised supporting of the junction between the coal face and the drift is not only desirable for reasons of safety, but also to improve the air supply at the said location, to increase the cutting speed for the longwall and thus its productivity, to ensure the protection of the transfer and take-over sections of the face transport and drift transport devices, and to make possible the continuous advance of the cutter in the vicinity of the transfer section without additional fixing measures and supplementary means. The force which arises when cutting tends to lift the transfer section upwards, and this is commonly prevented by inserting props at each cut. This solution is laborious and unprofitable since a step, which is generally 70–80 cm long depending on the hardness of the coal, can only be cut with 4 to 5 cuts and repeated propping up.

SUMMARY OF THE INVENTION

An object of the invention is to provide a mechanised longwall system for mining, in which the junction between the mining face and the drift is provided with mechanised support units which can be moved together with the drive and reversing station of the face transport device in the same way as the longwall support units.

According to the invention, a mechanised longwall system for mining of the kind referred to above is characterized in that at least two drift supporting units are provided to be arranged in the drift adjacent to each other, in the said drift supporting units each have a supplementary floor element connected via a linkage to the front end of its floor element, in that a supplementary prop is connected via linkages between the supplementary floor element and the front end of the roof element, and in that the floor element and supplementary floor element of the outermost drift supporting unit (i.e. that unit of the two adjacent drift supporting units lying further from the face) are constructed so as to accommodate a take-over section and a reversing unit of the drift transport track, a transfer unit of the face transport track being arranged to project over the take-over section of the drift transport track, whilst the supplementary floor element of the outermost drift supporting unit accommodates a guide system for guiding the transfer unit in the longitudinal direction of the drift transport track, and a fluid operated advancing cylinder, one end of which is hinged onto the transfer unit while the other end is connected to the floor element and/or to the supplementary floor element of said outermost drift supporting unit.

In one preferred embodiment of the longwall system according to the invention the system which guides the transfer unit in the longitudinal direction of the drift transport track consists of a rail equipped with a head part, and a guide groove which accommodates the head part of the rail, and the rail is expediently constructed on the supplementary floor element of the outermost drift supporting unit.

According to a preferred feature of the invention, the transfer unit has a sliding carriage-type bearing member which bridges over the supplementary floor element of at least two drift supporting units, and the guide groove is defined in this bearing member.

In a further preferred feature according to the invention the bearing member has a guide attachment which fits that side of the supplementary floor element of said other drift supporting unit which is nearer to the mining face.

According to another advantageous feature the transfer unit is hinged onto the floor element and/or onto the supplementary floor element of said other drift supporting unit via an advancing cylinder.

Conveniently, the floor element and supplementary floor element of each of the drift supporting units are connected to each other via a connecting component which is constructed with articulations at both its ends. Thus, with a mechanised longwall system for mining according to the invention, the junction between the drift and the mining face is also equipped with mechanised supporting which is suitable for accommodating and anchoring or moving the drive head of the face transport track and the cutter in such a way that the cutter can be operated continuously during movement of the drive head without any danger of the drive head and the face transport track being drawn together. The entire gallery roof is clad above the drive motors. Behind the drift supporting units the gallery roof can be broken out in the normal way with a face supporting unit, and it is not necessary to leave behind a clad section of drift and subsequently to recover the cladding assembly. By using a system according to the invention the safety and productivity of the longwall are significantly increased.

In order that the invention will be readily understood, one preferred embodiment will now be described, with reference to the accompanying drawings in which:

FIG. 1 is a plan view showing two of the face supporting units of the longwall system and two adjacent drift supporting units which adjoin these face supporting units and are located in the drift, FIG. 2 is a side view of the outermost drift supporting unit of the system shown in FIG. 1, FIG. 3 is a perspective view of the two adjacent drift supporting units of the system shown in FIG. 1, FIG. 4 is a section on line IV—IV of part of the outer face supporting unit and the two drift supporting units of the system shown in FIG. 1, and FIGS. 5a–5e are a series of schematic plan views showing the separate phases of a preferred movement arranged for the system.

DESCRIPTION OF THE PREFERRED EMBODIMENT

Figure 4:
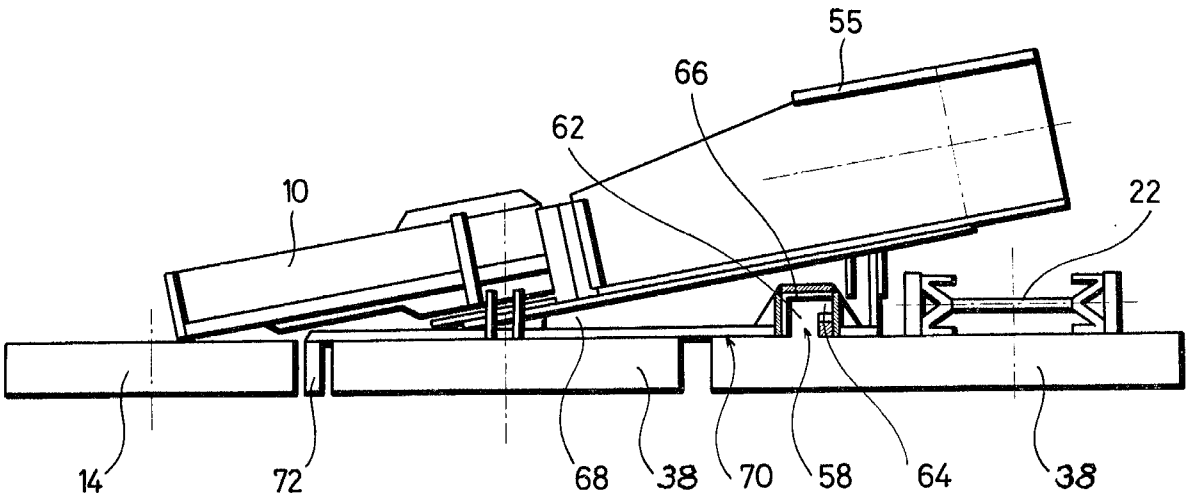

The system shown consits of conventional mechanised coal free supporting units 20 disposed adjacent to each other along the longwall 11 and connected via hydraulic advancing cylinders 12 (see FIG. 5) to a face transport track 10 which is laid over the length of the longwall 11. The supporting units 20 have a floor element 14 (see FIG. 4) and a roof element 18 supported by hydraulic props 16. The hydraulic props 16 are connected by their lower end to the floor element 14. The face supporting units 20 in this instance are generally of normal construction and, at the rear end of the floor element 14 of each unit a rear support element 15 is attached, on which a shield back 17 is hinged. The upper ends of the hydraulic props 16 and the roof element 18 are similarly hinged onto the shield back 17.

At the outer end of the face transport track 10 and perpendicular thereto a drift transport track 22 is arranged which extends along the drift 21. A takeover section 54 of said drift transport track is arranged partly underneath a transfer unit 55 formed at the end of the face transport track 10. A reversing unit 56 for the drift transport track 22 and also a drive 57 for the face transport track 10 are provided in line with the longwall 11. In this instance, the drive 57 is constructed as a front-end drive.

In the drift 21, two drift supporting units 24, 26 are arranged adjacent to each other and they adjoin the face supporting units 20. The inner space (i.e. the space defined within) of the drift supporting unit 24 is substantially clear, only the transport track 10 running through this inner space. The drive 57 and the transfer unit 55 of the face transport track 10, and also the take-over section 54 and the reversing unit 56 of the drift transport track 22 are arranged in the inner space of the outermost drift supporting unit 26 (i.e. that supporting unit which lies further from the mining face 11).

The rear part of each supporting unit 24, 26 is of a normal shield construction (in this embodiment, it will be appreciated that supporting units 20 are also constructed in this way), but the roof element 18 adjoining the shield back 17 is significantly longer than normal, and the roof element 18 is connected in the vicinity of its front end 28 via a linkage 30 to the upper end 34 of a supplementary hydraulic prop 32. Also at the front end 36 of their respective floor elements 14, a supplementary floor element 38 is connected via a connecting component 76, which latter is constructed with articulations at both its ends.

The rear end 40 of each supplementary floor element 38 is connected via a linkage 42 to its connecting element 76. A linkage 48, to which the lower end of each supplementary hydraulic prop 32 is connected, is constructed in the vicinity of the front end 44 of its respective supplementary floor element 38.

The floor element 14 and the supplementary floor element 38 of the outermost drift supporting unit 26 accommodate the take-over section 54 of the drift transport track 22, this being effecfted in such a way that the longitudinal axis of the take-over section 54 is parallel to the longitudinal axis of the floor elements 14, 38. The transfer section 55 of the face transport track 10 is disposed projecting out over the take-over section 54 of the drift transport track 22, and the drive 57 is disposed in between the props 16 and 32 with its drive axis projecting in the longitudinal direction.

The transfer unit 55 is arranged in the inner space of the drift supporting units 24, 26 in such a way that, above the supplementary floor elements 38 of the drift supporting units 24, 26, a bearing member 68 (see FIG. 4) constructed as a sliding carriage is disposed, having a guide system 58 on the supplementary floor element 38 of the outermost drift supporting unit 26 and a guide attachment 72 which fits on the nearer mining face side of the supplementary floor element 38 of supporting unit 24.

The guide system 58 which guides the bearing member 68 of the transfer unit 55 consists of the supplementary floor element 38 of the supporting unit 26, a rail 62 projecting upwardly from the parallel to the longitudinal axis of said supplementary floor element, and a guide groove 66 extending into the lower plate 70 of the bearing member 68. The rail 62 has a head part 64 and the guide groove 66 is constructed with a cross-section in the form of an inverted "L" so that the transfer unit 55 cannot be lifted off the rail 62. By means of the guide attachment 72 on the bearing member 68, the supplementary floor elements 38 of both supporting units 24, 26 are simultaneously prevented from moving away from each other and their parallel position is thus assured.

Figure 1:
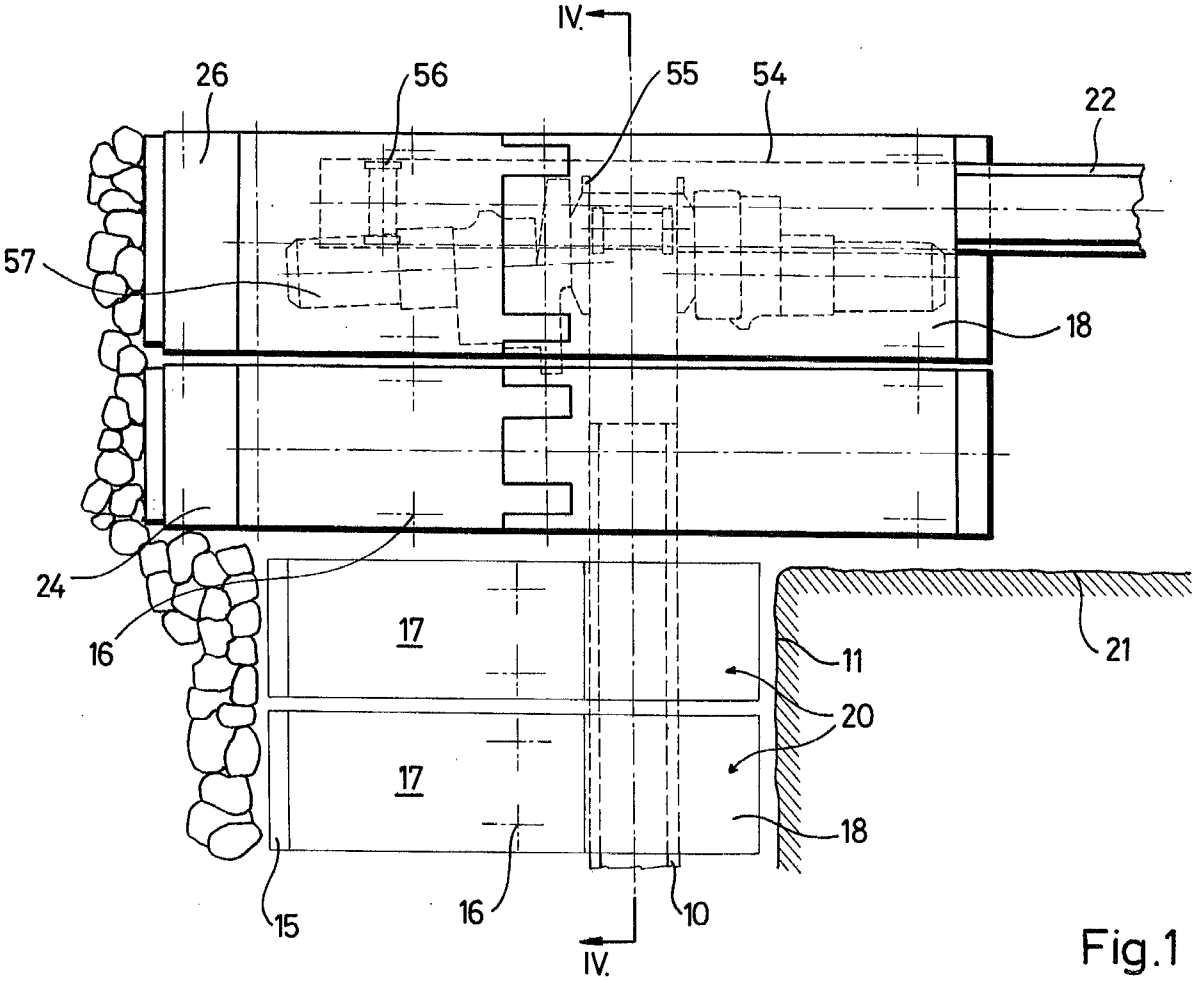
Figure 2:
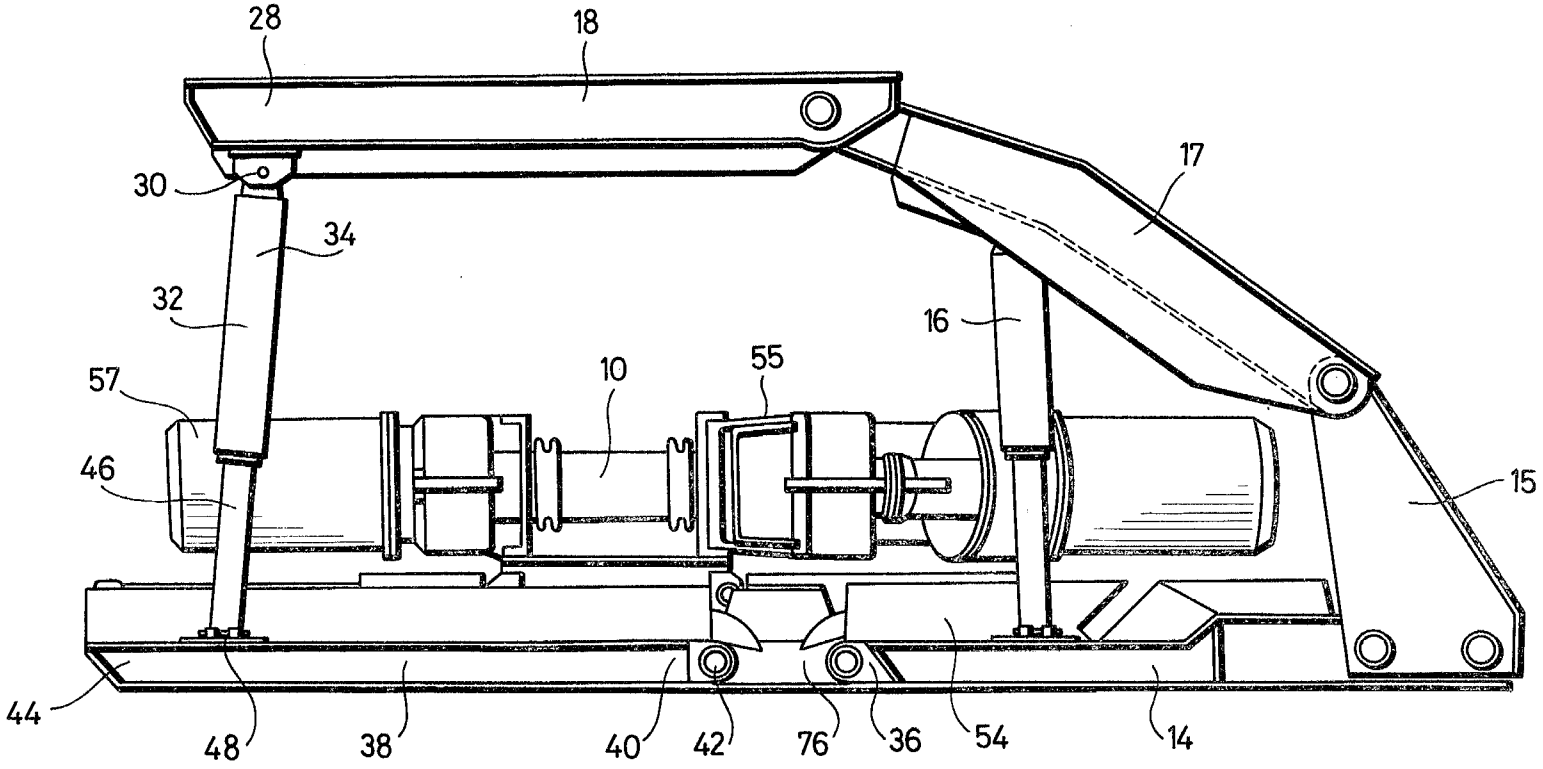
Figure 3:
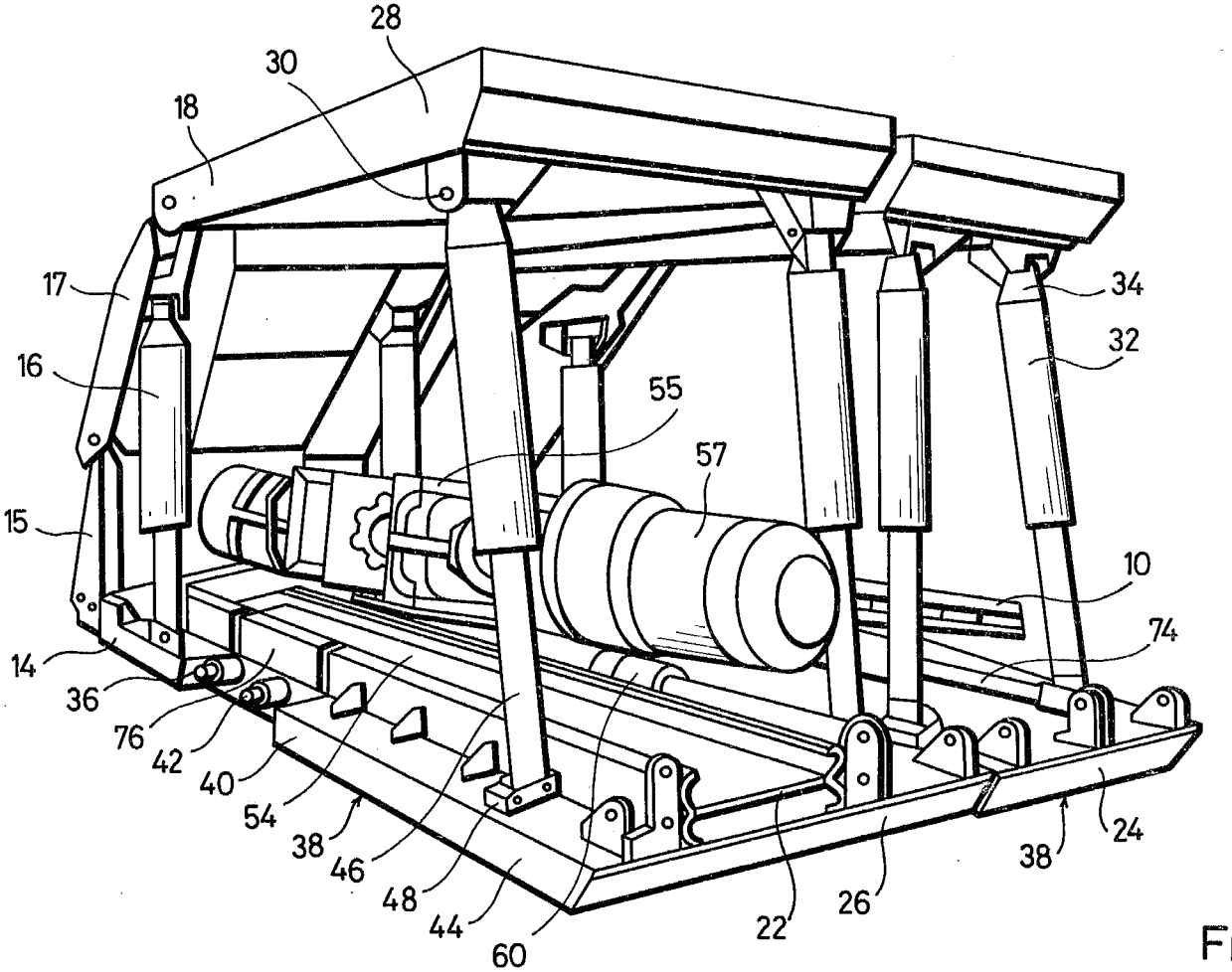

Between the transfer unit 55 and the supplementary floor element 38 of the outermost drift supporting unit 26 a hydraulic advancing cylinder 60 is inserted (see FIG. 3 and FIG. 5). Similarly, front and rear hydraulic advancing cylinders 74 (see particularly FIG. 5) are arranged between the supplementary floor element 38 and the transfer unit 55 and between said transfer unit and the floor element 14 respectively of the drift supporting unit 24.

In FIGS. 5*a*, 5*b*, 5*c*, 5*d* and 5*e*, the separate phase of the movement of the described system with respect to a coal face are illustrated.

Figure 5C:
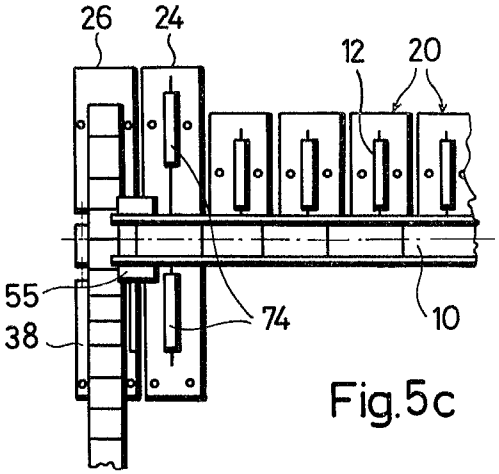
Figure 5B:
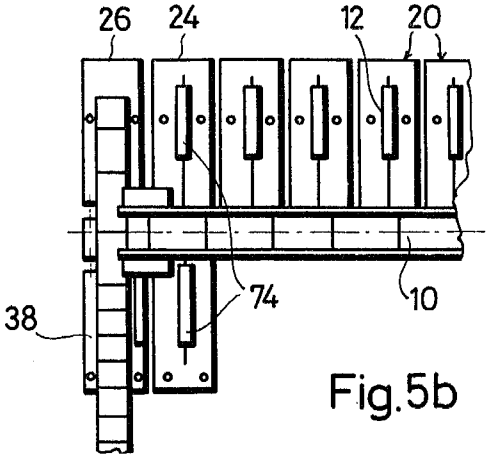
Figure 5A:
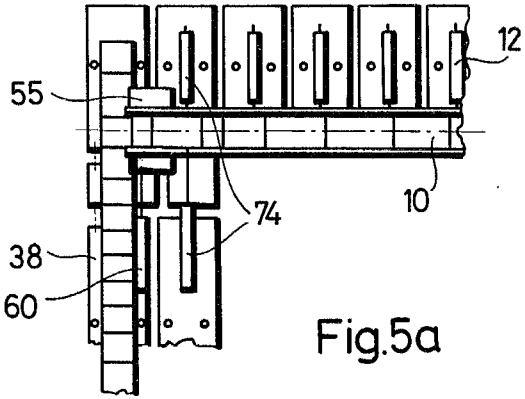

In the phase shown in FIG. 5*a* the hydraulic advancing cylinders 12 of the face supporting units 20 are retracted. The transfer unit 55 of the face transport track 10 connected to the hydraulic advancing cylinders 12 is thus in its retracted position (in its rear location), within the inner space of the drift supporting units 24, 26. Also the rear one of the hydraulic advancing cylinders 74 of the drift supporting unit 24 (i.e. that lying nearer the coal face) is in its retracted position, whilst the front one is in its extended position, and the hydraulic advancing cylinder 60 located between the supplementary floor element 38 and the transfer unit 55 of the outermost drift supporting unit 26 is also in the extended position.

In the phase shown in FIG. 5*b*, the face transport track 10 has been moved forwards by extending the advancing cylinders 12. In this case the transfer unit 55 of the face transport track 10 inside the drift supporting units 24, 26 is in its advance position (in its front location), the front advancing cylinder 74 of the supporting unit 24 and the advancing cylinder 60 of the supporting unit 26 are in their retracted positions, while the rear advancing cylinder 74 of the supporting unit 24 is in its extended position.

In the phase shown in FIG. 5*c* the face supporting units 20 are moved forwards individually to the face transport track 10 by retracting the advancing cylinder 12, while the position of the drift supporting units 24, 26 remains unchanged.

Figure 5E:
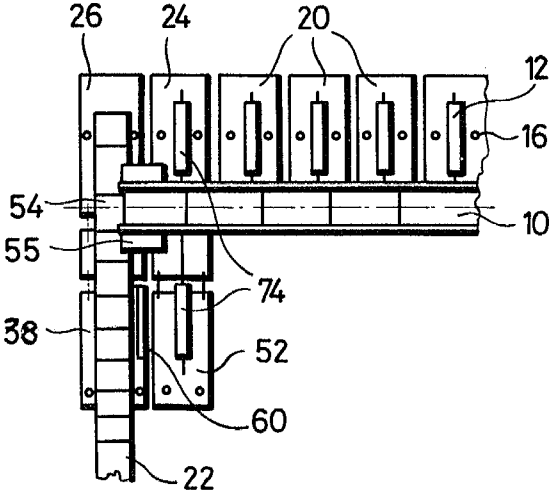
Figure 5D:
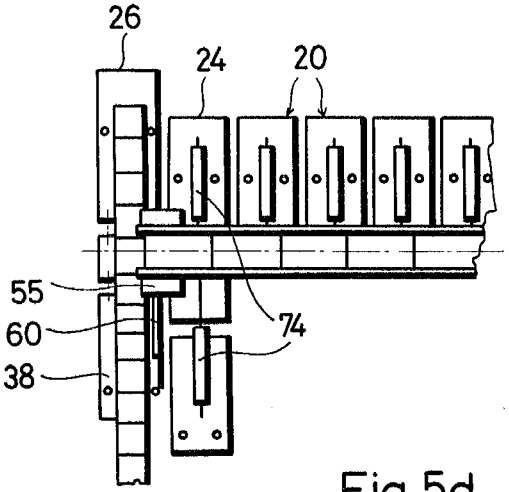

In the phase shown in FIG. 5*d*, by extending the front advancing cylinder 74 and by retracting the rear advancing cylinder 74, the drift supporting unit 24 (lying nearer the face) is moved into alignment with the coal face supporting units 20, so that the transfer unit 55 is set to its rear position relative to the supporting unit 24, the position of the outermost drift supporting unit 26 remaining unchanged.

In the phase shown in FIG. 5*e* the outermost drift supporting unit 26 is moved into alignment with the face supporting units 20 and the drift supporting unit 24 by extending the advancing cylinder 60, while the transfer unit 55 is set to its rear position relative to the supporting unit 26, and the situation shown in FIG. 5*a* again prevails, except that the whole system has moved one step forwards.

The drift transport track 22 is constructed as a bridging transport device, and the section of it which is connected to the drift supporting unit 26 slides during the advancing movement on that section of it which lies in the drift 21, which latter section can e shortened according to requirements during the course of the advance.

We claim:

1. A mechanized longwall system for mining including face roof supporting units disposed adjacent each other along the longwall, fluid operated advancing cylinders connecting said roof supporting units to a face transport track laid over the length of the longwall, each supporting unit comprising a floor element and a roof element, hydraulic props supporting said roof elements by coupling to said floor elements, a drift transport track mounted at and perpndicular to one end portion of the face transport track for extending into the drift in the conveying direction, said system further comprising at least two drift supporting units adjoining said face roof supporting units and located in the drift adjacent to each other, said drift supporting units each having a supplementary floor element, a linkage connecting each of said drift supporting units to the front end of the floor element thereof, a supplementary prop, linkages connecting said supplementary prop between the supplementary floor element and the front end of the roof element, the floor element and supplementary floor element of the outermost drift supporting unit of the said two adjacent drift supporting units lying further from the face are constructed for receiving a take-over section and a reversing unit of the drift transport track, a transfer unit formed at the end of the face transport track for projecting over the take-over section of the drift transport track, a guide system including said supplementary floor element of the outermost drift supporting unit for guiding the transfer unit in the longitudinal direction of the drift transport track and a fluid operated advancing cylinder, one end of said advancing cylinder being hinged onto the transfer unit, the other end of said cylinder being connected to the floor element and/or to the supplementary floor element of said outermost drift supporting unit.

2. A mechanised longwall system according to claim 1, characterised in that the guide system for guiding the transfer unit in the longitudinal direction of the drift transport track consists of a rail equipped with a head part and a guide groove for receiving the head part of the rail, the rail being mounted on the supplementary floor element of said outermost drift supporting unit.

3. A mechanised longwall system according to claim 2, characterised in that the transfer unit has a bearing member constructed as a sliding carriage and bridging over the supplementary floor elements of at least two drift supporting units, and the guide groove is defined in this bearing member.

4. A mechanised longwall system according to claim 3, characterised in that the bearing member has a guide attachment which fits on the nearer mining face side of the supplementary floor element of said other drift supporting unit.

5. A mechanised longwall system according to claim 1 characterised in that the transfer unit is coupled by a fluid operated advancing cylinder onto the floor element and/or the supplementary floor element of said other drift supporting unit.

6. A mechanised longwall system according to claim 1, characterised in that the floor element and the supplementary floor element of each of the drift supporting units are connected to each other via a connecting component which is constructed with articulations at both its ends.

* * * * *